US005499463A

United States Patent [19]

Profio et al.

[11] Patent Number: 5,499,463

[45] Date of Patent: Mar. 19, 1996

[54] POWER SHOVEL WITH VARIABLE PITCH BRACES

[75] Inventors: Richard L. Profio, Wauwatosa; Frederick W. Loeber, Delafield, both of Wis.

[73] Assignee: Harnischfeger Corporation, Brookfield, Wis.

[21] Appl. No.: 323,637

[22] Filed: Oct. 17, 1994

[51] Int. Cl.[6] ..... E02F 3/81

[52] U.S. Cl. ..... 37/398; 37/445; 414/726

[58] Field of Search ..... 37/397, 398, 399, 37/403, 431, 445; 29/148.3, 445; 414/726, 723

[56] References Cited

U.S. PATENT DOCUMENTS

| | | | |
|---|---|---|---|
| 3,278,057 | 10/1966 | Drollinger et al. | 214/146 |
| 3,867,750 | 2/1975 | Den Bleyker | 29/148.3 |
| 3,881,612 | 5/1975 | Wells | 414/723 X |
| 3,933,260 | 1/1976 | Kronlokken et al. | 214/138 |
| 4,178,030 | 12/1979 | Dolinsek | 294/70 |
| 5,251,389 | 10/1993 | Bessey | 37/398 |

*Primary Examiner*—Eric K. Nicholson
*Assistant Examiner*—Robert Pezzuto
*Attorney, Agent, or Firm*—Michael, Best & Friedrich

[57] ABSTRACT

A power shovel comprising a frame, a dipper handle mounted on the frame for pivotal movement relative thereto about a generally horizontal dipper handle axis such that the dipper handle has a variable pivotal position relative to the frame, a dipper connected to the handle for pivotal movement relative thereto about a generally horizontal dipper axis such that the dipper has a variable pivotal position relative to the handle, and a variable pitch brace connected between the handle and the dipper at a point spaced from the dipper axis, the variable pitch brace including a spring biasing the dipper in one rotational direction relative to the handle and about the dipper axis, such that the pivotal position of the dipper automatically varies depending on the pivotal position of the handle and on external forces on the dipper.

28 Claims, 6 Drawing Sheets

POWER SHOVEL WITH VARIABLE PITCH BRACES

BACKGROUND OF THE INVENTION

1. Field of the Invention

The invention relates to power shovels, and more particularly to power shovels having a dipper moved by a rope or cable.

2. Reference to the Prior Art

A well-known type of power shovel includes a revolvable upper frame mounted on a mobile base such as crawler tracks. A fixed boom extends upwardly and outwardly from the frame. A dipper handle is mounted on the boom for movement about a rack and pinion or crowd drive mechanism for pivotal and translational (non-pivotal) movement relative to the boom. A dipper is fixed to the end of the dipper handle. The outer end of the boom has thereon a sheave, and a hoist cable or rope extends over the sheave from a winch drum on the frame and is fastened to the dipper to support and partially control movement of the dipper.

The angle between the dipper teeth and the handle (known as the "tooth cutting" angle), is maintained by a pitch brace connected between the dipper and the handle. The pitch brace is typically a rigid length of steel connected by a pin at one end to the dipper and at the other end to the handle. Manually changing the pitch brace is expensive and time-consuming.

U.S. Pat. No. 5,251,389, which is assigned to the assignee hereof, discloses a pitch brace that can be adjusted by turning a collar to vary the length of the brace.

U.S. Pat. No. 3,278,057 discloses a hydraulic mechanism for adjusting the angle of the dipper relative to the dipper handle.

U.S. Pat. No. 3,933,260 discloses an arrangement using two hoist ropes for adjusting the angle of the dipper relative to the dipper handle.

SUMMARY OF THE INVENTION

The invention provides a variable pitch brace that replaces the conventional rigid or fixed-length pitch brace and that functions as a shock attenuator or shock absorber between the dipper and the dipper handle. The variable pitch brace helps prevent breakage of the dipper teeth and other power shovel components, including the entire crowd drive power train, when the dipper is dropped on or otherwise impacts the ground. The preferred shock attenuator is a simple spring device that provides suspension without damping, except for minimal friction. It should be understood, however, that the shock attenuator could provide damped suspension, i.e., suspension with friction that controls loading rates. A damped suspension device could be elastomeric or polymeric or could use compressible liquids.

The variable pitch brace also functions, without direct operator control, to automatically adjust the tooth cutting angle during the dig/fill portion of the digging cycle. By "without direct operator control" it is meant that the operator does not directly manipulate the brace as with the brace of U.S. Pat. No. 5,251,389, and does not use a mechanism like the hydraulic mechanism of U.S. Pat. No. 3,278,057 or the two hoist ropes of U.S. Pat. No. 3,933,260 for adjusting the angle of the dipper relative to the dipper handle. In other words, the automatic adjustment of the tooth cutting angle results only from the variable pitch brace itself, from the position of the dipper, and from the combined crowd and hoist forces that are applied to the dipper during a normal digging cycle. The variable pitch brace improves the digging performance of a power shovel without requiring structural alterations to the shovel. The brace is self-contained and is fitted to the shovel in the same manner as a conventional fixed-length brace.

More particularly, each variable pitch brace includes an articulated brace comprised of two links pivotally pinned together. An armored gas spring is fitted between two attachment points (one on each link of the brace) so as to bias the links in one angular direction relative to each other (in the direction of "unfolding"). The articulated brace and gas spring assembly replaces the traditional fixed-length pitch brace.

Reducing pitch brace length during the active portion of the dig cycle increases the tooth cutting angle, which in turn improves the dipper fill factor and reduces cycle time and dipper wear. During the active portion of the dig cycle, over a span of approximately 45° of dipper handle rotation, the force relationships between bailpull, pitch brace load, dipper fill and tooth loading induce an increase in the strut loading of the pitch brace. A pitch brace that is preloaded and can shorten under digging loads allows the angular relationship between the dipper and the dipper handle to change, resulting in a desirable tooth cutting angle increase.

Normal axial loading of the pitch brace causes the articulated brace to fold. Folding continues until terminated by a mechanical stop. The brace thereafter carries high loading without further deflection. Release of the external loading conditions in combination with the bias of the gas spring causes the pitch brace to return to an unfolded or extended position which is also determined by a mechanical stop. In all cases, the gas spring is not allowed to bottom out or top out, thus prolonging the life of the spring in adverse mining conditions.

Other features and advantages of the invention will become apparent to those skilled in the art upon review of the following detailed description, claims and drawings.

Figure 1:
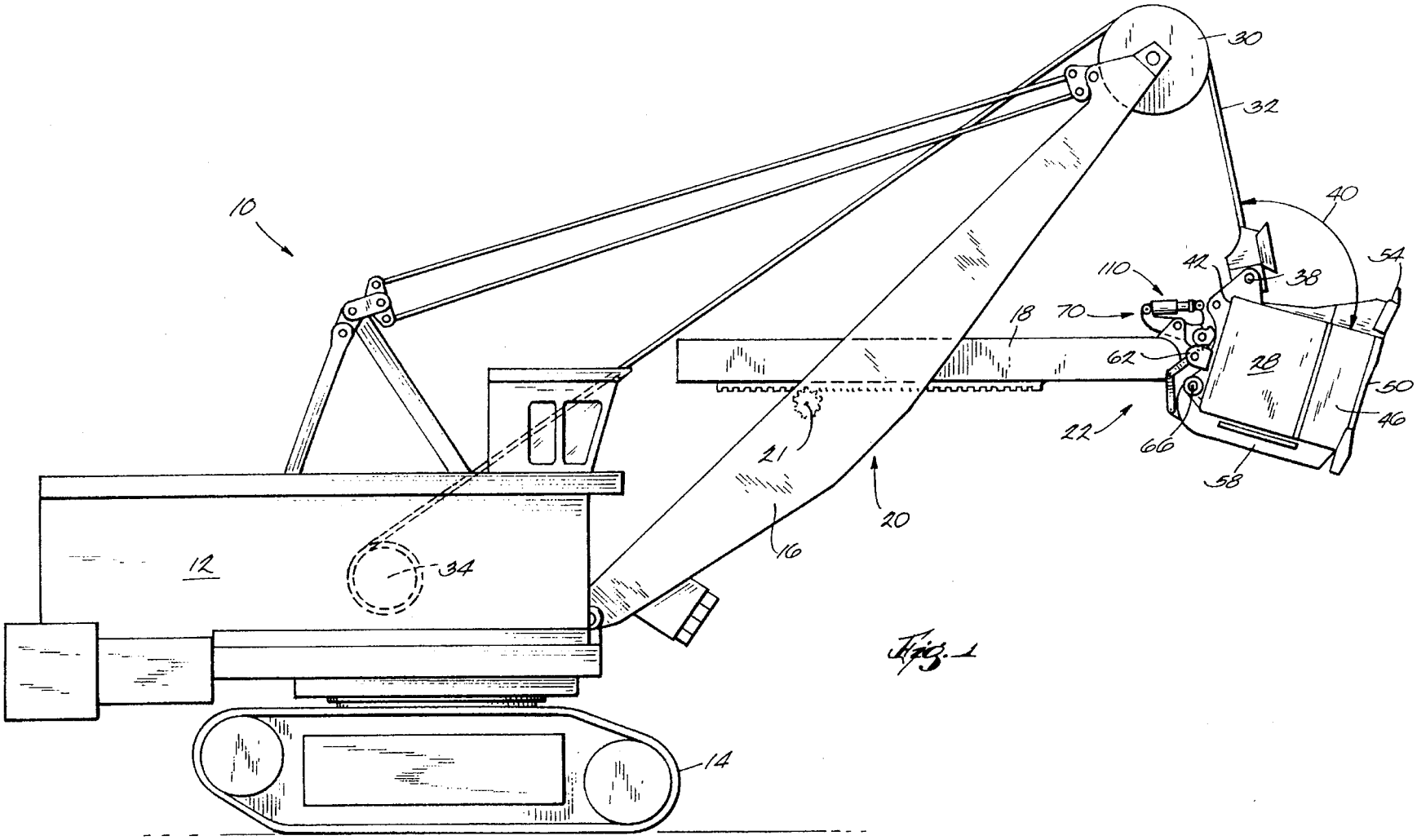
FIG. 1 is a side elevational view of a power shovel embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Illustrated in the drawings is a power shovel 10 embodying the invention. The power shovel 10 includes (see FIG. 1) a revolvable upper frame 12 mounted on a set of crawler tracks 14. A fixed boom 16 extends upwardly and outwardly from the frame 12. A dipper handle 18 is supported on the boom 16 by a crowd drive mechanism 20 for pivotal movement relative to the boom 16 about a horizontal dipper handle axis 21 and for translational movement relative to the boom 16. The crowd drive mechanism 20 can be a rack and pinion (as illustrated) or wire rope mechanism or hydraulic mechanism or any other suitable mechanism. The dipper handle 18 thus has a variable pivotal position relative to the frame 12 or boom 16 and a variable translational position relative to the frame 12 or boom 16. The dipper handle 18 has a forward end 22. A dipper 28 is mounted on the forward end 22 of the dipper handle 18 in a manner described below. The outer end of the boom 16 has thereon a sheave 30, and a hoist cable or rope 32 extends over the sheave 30 from a winch drum 34 mounted on the frame 12 and is connected to the dipper 28 for pivotal movement relative thereto about a horizontal pivot axis 38. An angle 40 is defined between the rope 32 and the dipper 28. As used herein, "hoist rope" includes one or more hoist ropes. Preferably, two hoist ropes extend from the winch drum 34 to the dipper 28.

The dipper 28 will be described with reference to FIG. 1, in which the dipper handle 18 is shown in a generally horizontal position. The dipper 28 includes a back wall 42 connected to the forward end 22 of the dipper handle 18 in a manner described below. The back wall 42 extends generally vertically when the dipper handle 18 is in the horizontal position. The dipper 28 also includes opposite side walls 46 (only one is shown) extending forwardly from the back wall 42, and a front wall 50 which extends generally vertically when the dipper handle 18 is in the horizontal position. Digging teeth 54 extend from the upper end of the front wall 50. As shown in FIG. 2, the dipper handle 18 has a centerline 55, and the tooth cutting angle 56 is defined between the centerline of the teeth 54 and the centerline 55 of the dipper handle 18. The dipper 28 also includes (see FIG. 1) a door 58 pivotally connected to the back wall 42 adjacent the lower end thereof. The door 58 is movable between open and closed positions as is known in the art. Conventional snubbers 62 damp movement of the door 58. A latch mechanism (not shown) releasably secures the door 58 in the closed position.

Figure 2:
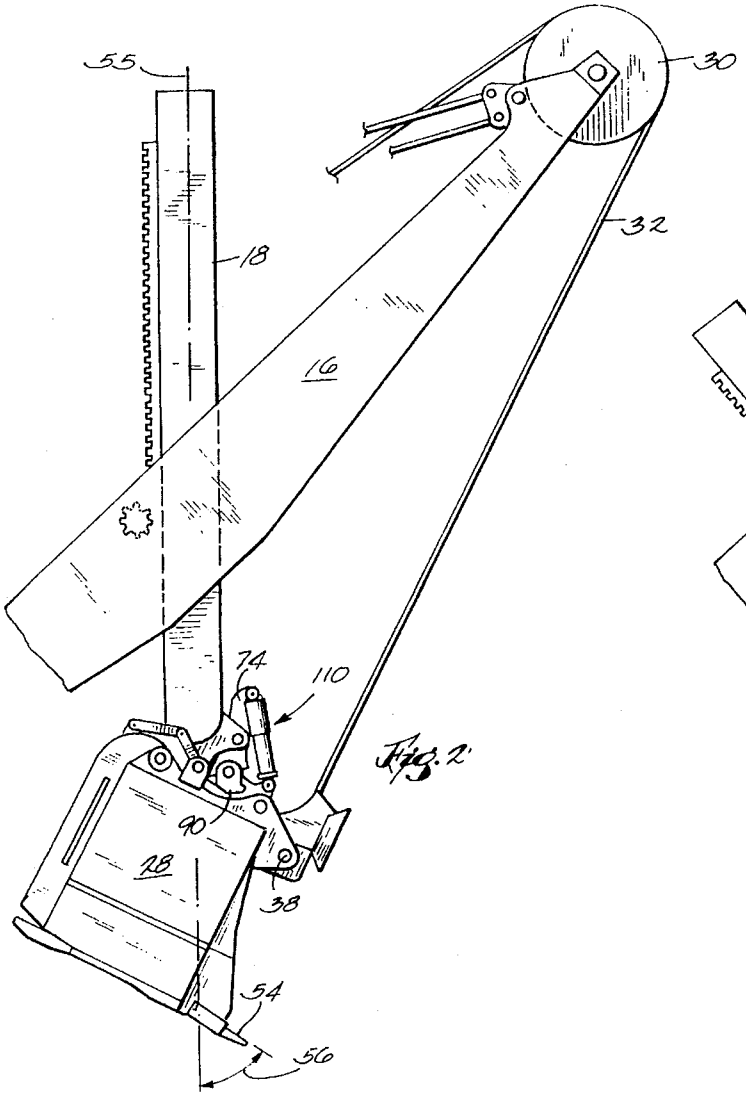
FIG. 2 is an enlarged portion of FIG. 1 showing the dipper handle in a generally vertical position and the dipper in a tucked position.

The back wall 42 of the dipper 28 (and thus the dipper 28) is connected to the dipper handle 18 for pivotal movement relative thereto about a generally horizontal lower dipper axis 66 (see FIG. 1). The dipper 28 thus has a variable pivotal position relative to the dipper handle 18. In the illustrated construction the lower dipper axis 66 is coaxial with the axis of pivotal movement of the door relative to the dipper 28. These axes need not, however, be coaxial. The tooth cutting angle 56 of the dipper 28 is controlled by a pair of variable pitch braces or shock attenuators 70 (only one is shown) connected between the dipper 28 and the dipper handle 18. One brace 70 is mounted on each side of the dipper 28. The braces 70 are substantially identical, and only one is described.

Figure 6:
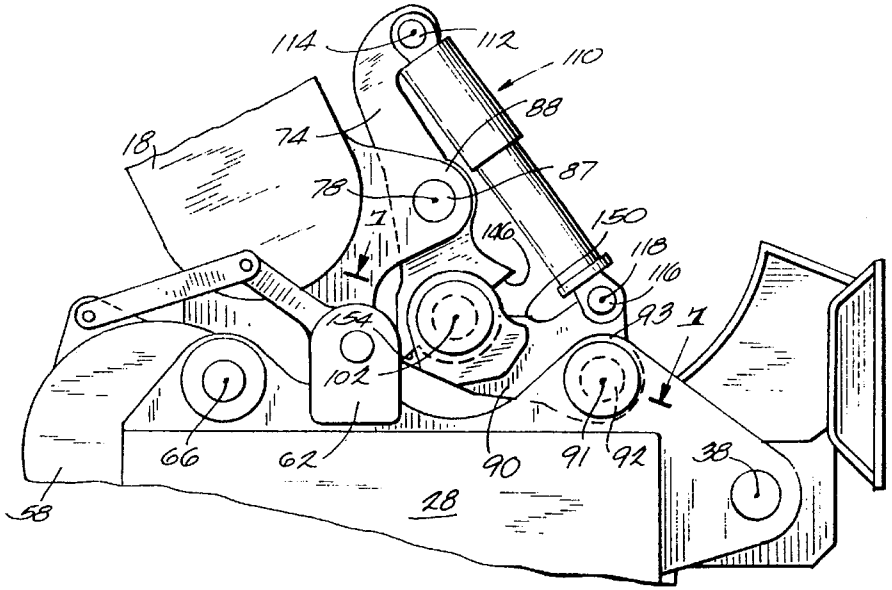
FIG. 6 is a further enlarged, partial view of the dipper and dipper handle showing the gas spring fully extended.
Figure 7:
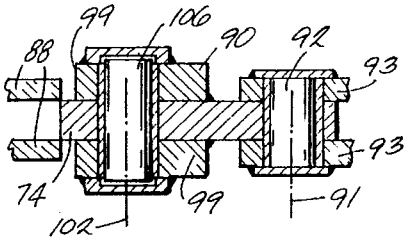
FIG. 7 a view taken along line 7—7 in FIG. 6.

The variable pitch brace 70 includes (see FIGS. 6–9) a first link 74 connected to the dipper handle 18 for pivotal movement relative thereto about a generally horizontal upper handle axis 78 spaced from the lower dipper axis 66. The first link 74 has (see FIG. 9) inner and outer or lower and upper ends 82 and 86, respectively. The first link 74 is pivotally connected to the dipper handle 18 at a point intermediate the inner and outer ends of the first link 74. As shown in FIGS. 6 and 7, the link 74 extends between and is pivotally connected by a pin 87 (see FIG. 6) to spaced ears 88 on the dipper handle 18. The variable pitch brace 70 also includes (see FIGS. 6–9) a second link 90 connected to the dipper 28 for pivotal movement relative thereto about a generally horizontal upper dipper axis 91 spaced from the lower dipper axis 66. As shown in FIGS. 6 and 7, the link 90 extends between and is pivotally connected by a pin 92 to spaced ears 93 on the dipper 28. The second link 90 has (see FIG. 9) inner and outer or left and right ends 94 and 98, respectively, and the link 90 is pivotally connected to the dipper 28 at a point intermediate the inner and outer ends of the link 90. More specifically, the link 90 includes a pair of ear portions 99 fixed (such as by welding) to a main portion 100. The main portion 100 is pivotally connected to the dipper 28.

The inner ends 82 and 94 of the links 74 and 90 are connected for relative pivotal movement about a generally horizontal link axis 102 (see FIGS. 6 and 8) spaced from the upper handle axis 78 and from the upper dipper axis 91. As shown in the drawings, the inner end of the link 74 extends between the ear portions 99 of the link 90 and is pivotally connected to the ear portions 99 by a pin 106 (see FIG. 7). As is apparent from viewing FIG. 6, pivotal movement of the links 74 and 90 relative to each other changes the angle between the links 74 and 90 and changes the distance between the upper handle axis 78 and the upper dipper axis 91, thereby changing the tooth cutting angle 56 of the dipper 28.

Figure 10:
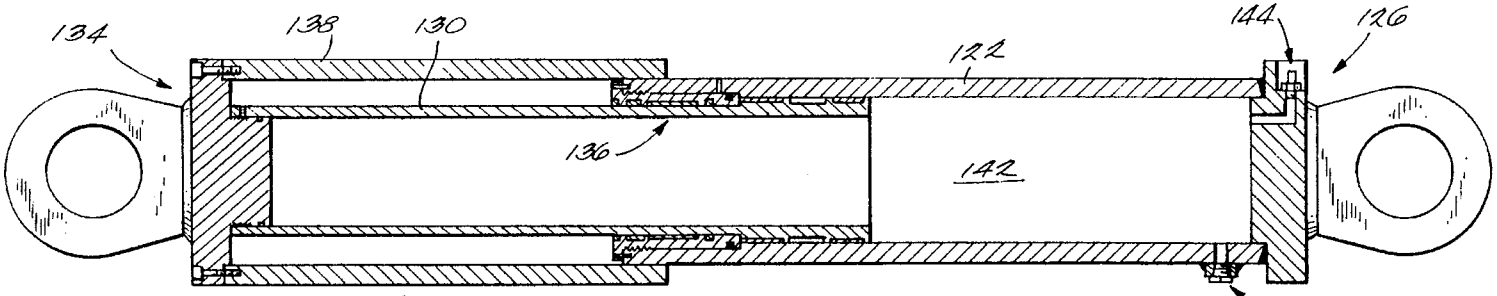
FIG. 10 is a cross-sectional view of the gas spring.

The variable pitch brace 70 also includes (see FIGS. 6, 8 and 10) a spring 110 extending between the links 74 and 90. Preferably, the spring 110 has one end (the upper end in FIG. 6) connected by a pin 112 to the outer end of the first link 74 for pivotal movement relative thereto about a generally horizontal axis 114, and has an opposite end (the lower end in FIG. 6) connected by a pin 116 to the outer end of the second link 90 for pivotal movement relative thereto about a generally horizontal axis 118. Although any suitable type of spring can be employed, the spring 110 is preferably an armored gas spring and is best illustrated in FIG. 10. The spring 110 includes a cylinder portion 122 having a blind end 126 pivotally connected to the link 90. A rod portion 130 slides within the cylinder portion 122 and has a blind end 134 pivotally connected to the link 74. Seals 136 are provided between the cylinder portion 122 and the rod portion 130. A protective sleeve portion 138 is fixed to the rod portion 130 and slides outside the cylinder portion 122. A hollow chamber 142 defined by the cylinder and rod portions is filled with oil and a compressible gas, preferably nitrogen. The oil is introduced through an oil fill port 143 and the gas is introduced through a charge valve 144. Contraction of the spring 110 reduces the volume of the chamber 142 and increases the gas pressure, and extension of the spring 110 increases the volume of the chamber 142 and reduces the gas pressure. Such a gas spring is well known in the art and will not be described in greater detail.

As is apparent from viewing FIG. 6, the dipper 28 pivots relative to the dipper handle 18 and about the lower dipper axis 66 coincident with extension and contraction of the spring 110. The spring 110 biases the dipper 28 in the clockwise rotational direction (as shown in FIG. 6) relative to the handle 18 and about the lower dipper axis 66. In other words, the spring 110 biases the upper end of the dipper 28 away from the handle 18 when the handle is in a generally horizontal position (as shown in FIG. 1). Stated another way, the spring 110 biases the dipper 28*a* in the direction reducing the tooth cutting angle 56, or biases the upper dipper axis 91 away from the upper handle axis 78. Thus, extension and contraction of the spring 110 varies the distance between the upper handle axis 78 and the upper dipper axis 91.

Figure 8:
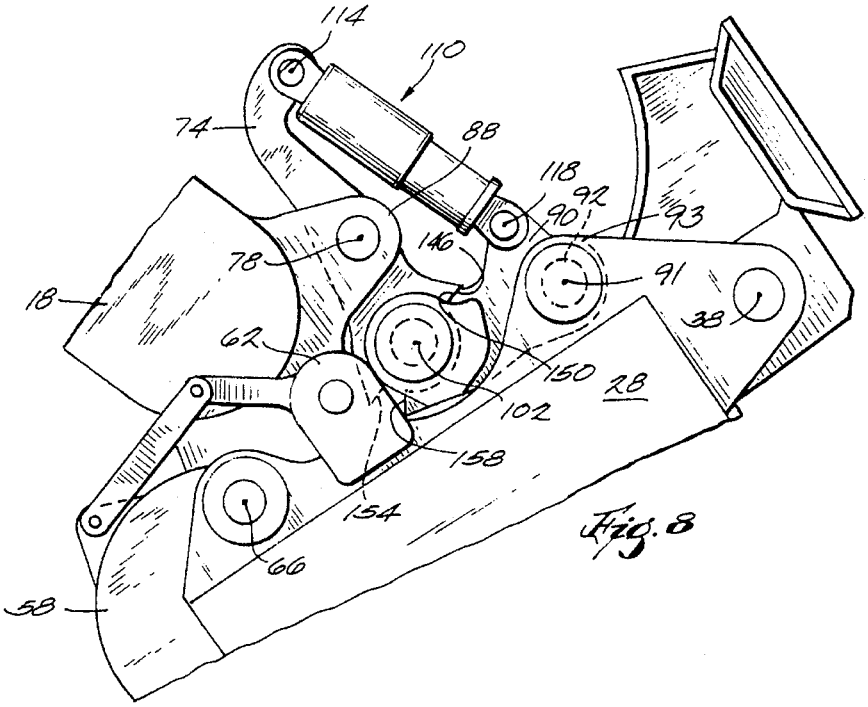
FIG. 8 is a view similar to FIG. 6 showing the gas spring fully contracted.
Figure 9:
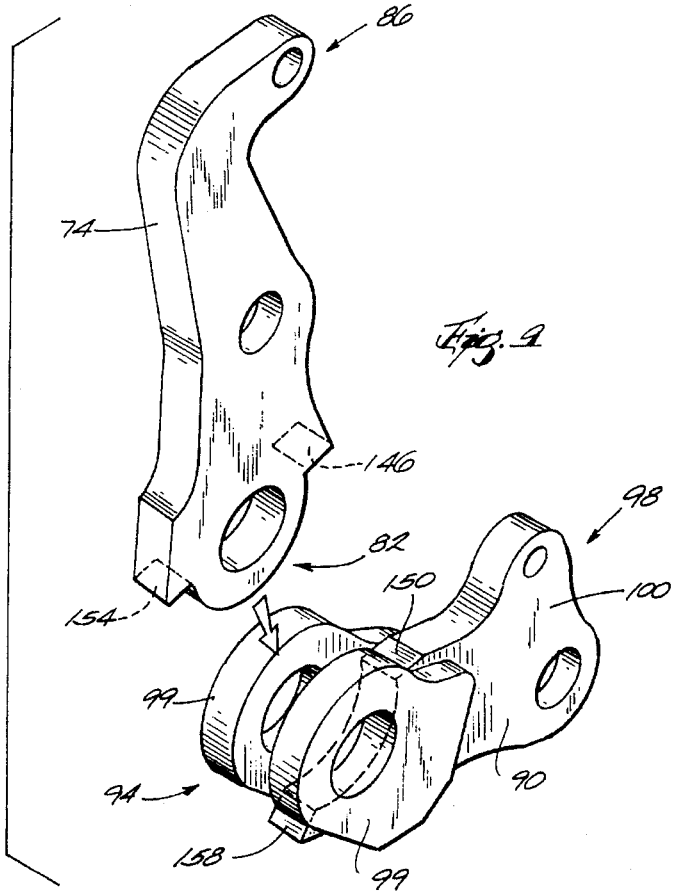
FIG. 9 is an enlarged, exploded perspective view of the links of the variable pitch brace.

The links 74 and 90 include a first mechanical stop limiting relative pivotal movement of the links 74 and 90 so as to limit contraction of the spring 110 and prevent the spring 110 from bottoming out. In the illustrated construction, the first stop includes (see FIGS. 6 and 9) a stop surface 146 on the first link 74 and a stop surface 150 on the second link 90. The surfaces 146 and 150 engage, as shown in FIG. 8, to limit contraction of the spring 110. The links 74 and 90 also include a second mechanical stop limiting relative pivotal movement of the links 74 and 90 so as to limit extension of the spring 110 and prevent the spring from overextending. The second stop includes (see FIGS. 8 and 9) a stop surface 154 on the first link 74 and a stop surface 158 on the second link 90. The stop surfaces 154 and 158 engage, as shown in FIG. 6, to limit extension of the spring 110.

The proper preload force and spring rate of the spring 110 depends on the particular power shovel to which the spring is applied. Proper spring force can only be determined by simple experimentation during operation of the power shovel. Also, the proper spring force will vary depending on the operating characteristics desired. On one well-known type of power shovel, a P&H 4100 manufactured by Harnischfeger Corporation, the preferred spring force is believed to be between 20,000 and 28,000 pounds. Preferably, the power shovel 10 operates as follows.

Figure 3:
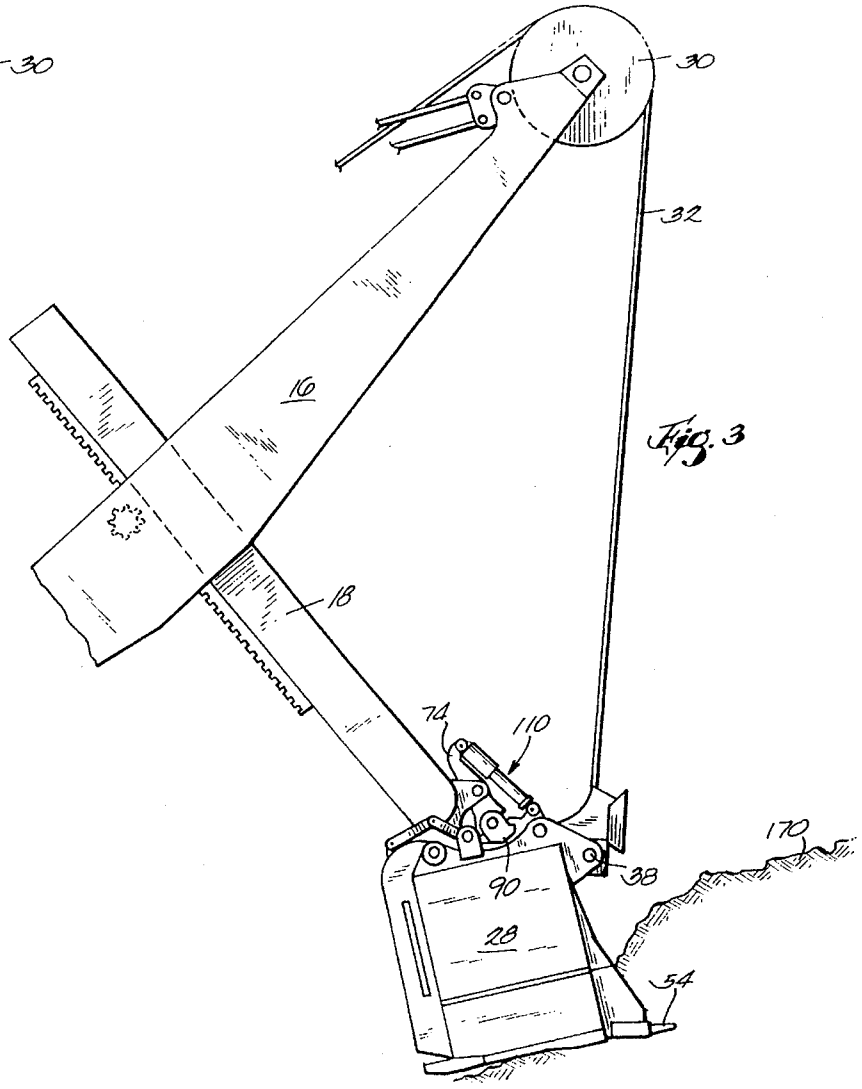
FIG. 3 is a view similar to FIG. 2 wherein the dipper handle has moved counterclockwise relative to FIG. 2.
Figure 5:
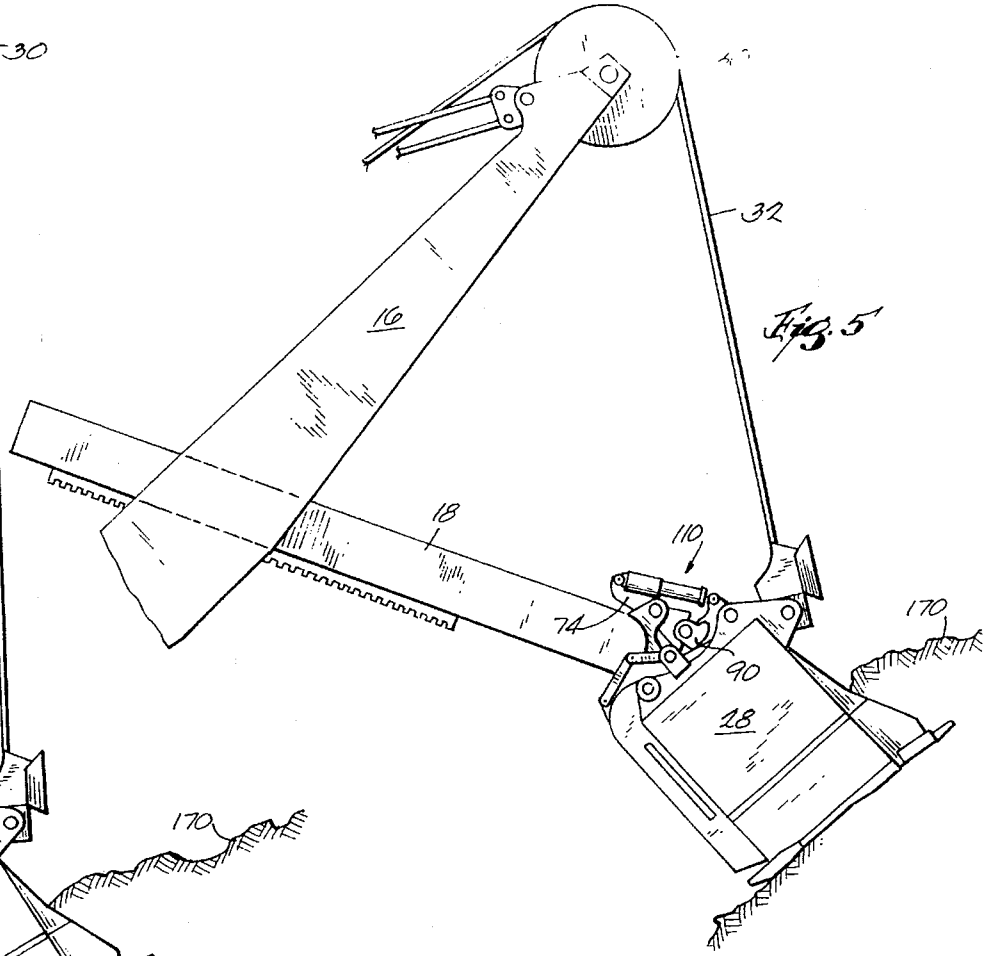
FIG. 5 is a view similar to FIG. 4 wherein the dipper handle has moved counterclockwise relative to FIG. 4.
Figure 4:
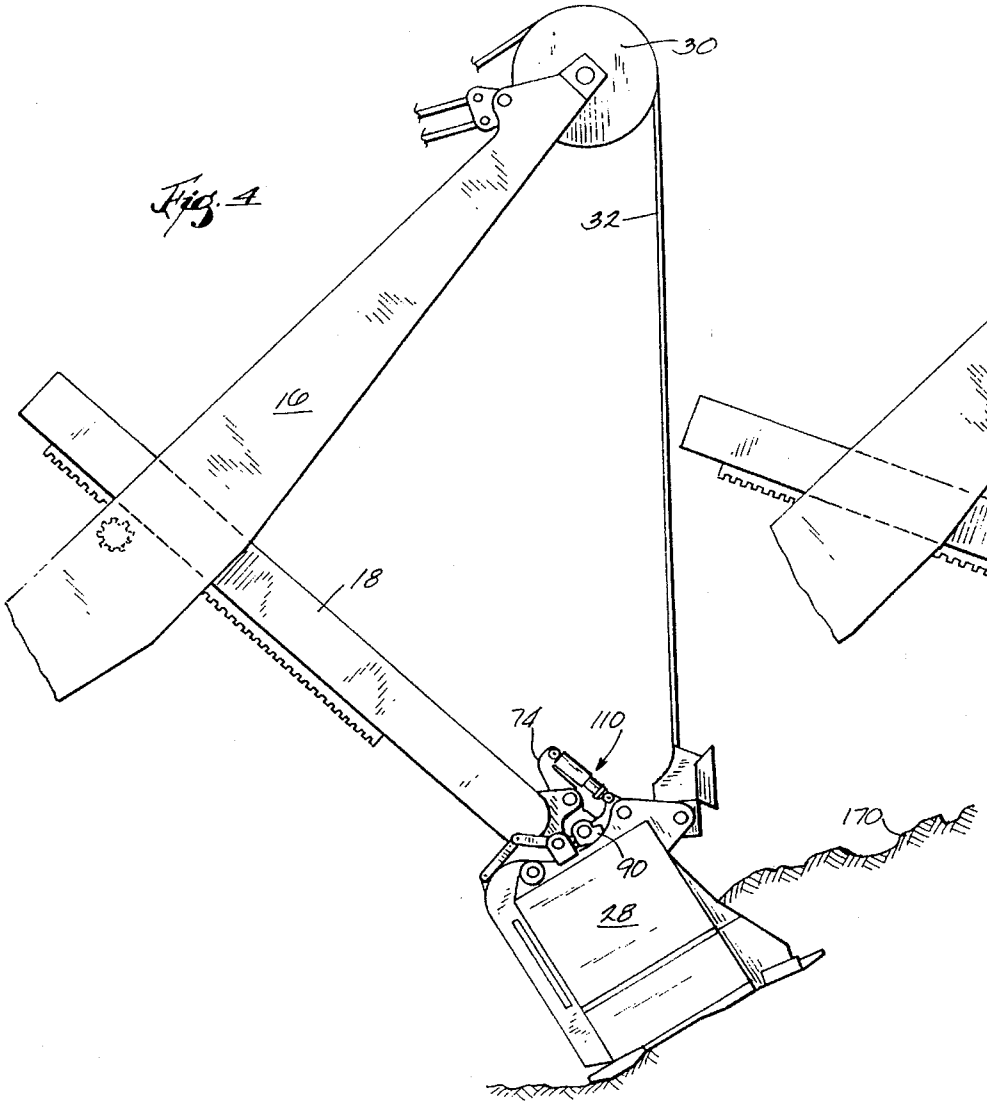
FIG. 4 is a view similar to FIG. 3 wherein the dipper handle has moved counterclockwise relative to FIG. 3.
Figure 11:
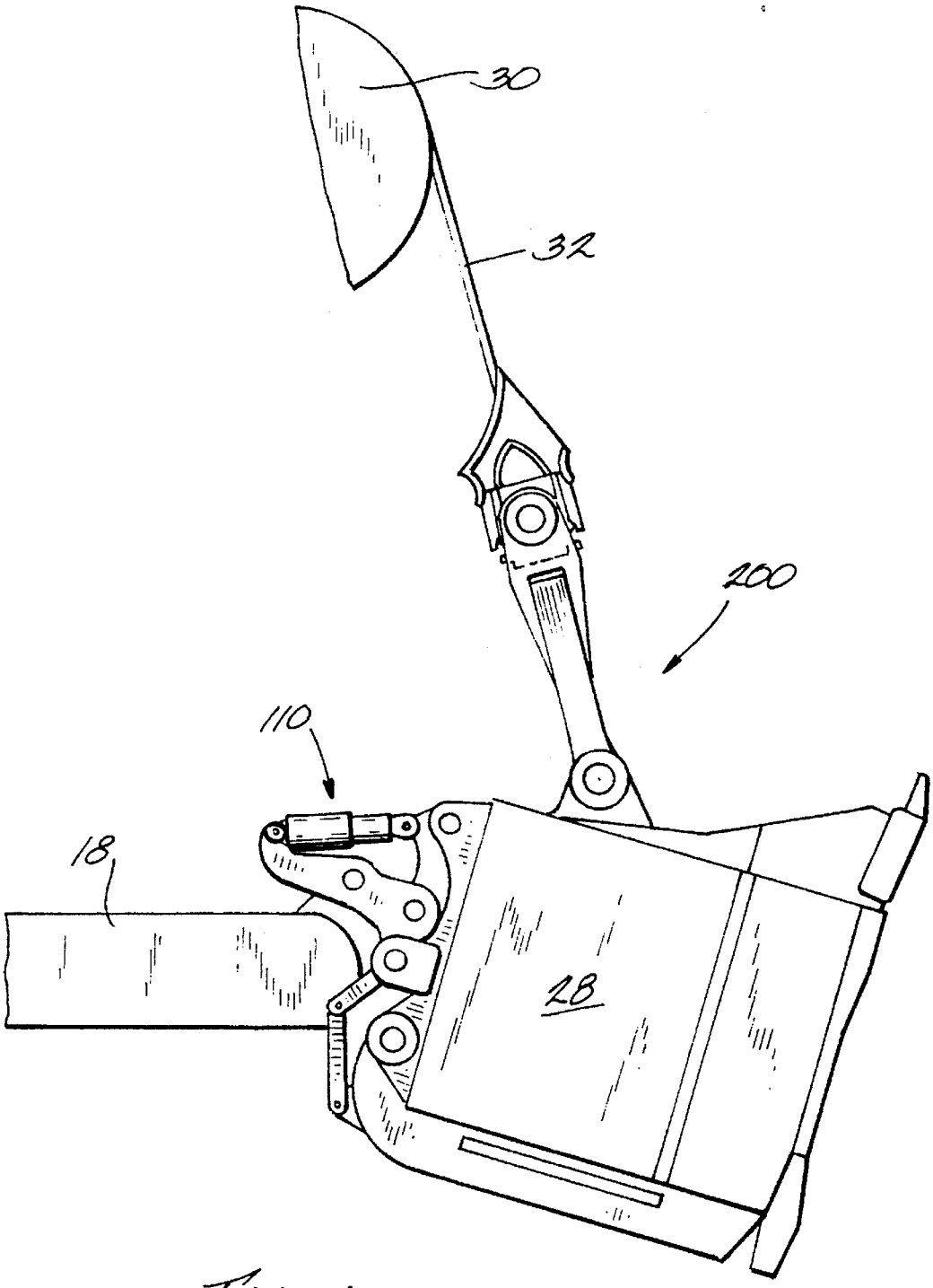
FIG. 11 is a partial side elevational view of a power shovel that is an alternative embodiment of the invention.

Operation begins with the dipper 28 in the tucked position and the latch mechanism engaged to retain the door 58 in the closed position, as shown in FIG. 2. In this position, with no external forces (i.e., forces not applied through the dipper handle or the rope) on the dipper 28, the spring 110 is fully extended, thereby minimizing the tooth cutting angle 56 of the dipper 28. The dipper handle 18 is then pivoted counterclockwise (as shown in the drawings), so that the dipper 28 contacts the ground or bank of material 170 being excavated, as shown in FIG. 3. At this point the lead (the material being excavated) exerts external forces on the dipper 28, but the spring 110 remains fully extended so that the tooth cutting angle 56 remains minimized. As the dipper handle 18 is pivoted further counterclockwise, as shown in FIG. 4, the dipper handle 18 is extended (crowded) as necessary for the dipper 28 to excavate more of the load. Crowding causes the spring 110 to contract, thereby increasing the tooth cutting angle 56 and increasing the fill factor of the dipper 28. As the dipper handle 18 is pivoted further counterclockwise, as shown in FIG. 5, the changes in forces (both external and otherwise) on the dipper 28 cause the spring 110 to extend again, thereby reducing the tooth cutting angle 56. Finally, when the dipper handle 18 reaches the horizontal position, as shown in FIG. 1, the bank is cleared and the extreme angle 40 of the rope 32 relative to the dipper 28, in combination with the other forces on the dipper 28, causes the spring 110 to once again contract, thus making the dipper 28 tip up and helping to retain the load in the dipper 28. It may be necessary to further crowd the dipper 28 to make the dipper 28 tip up as desired. Furthermore, it may be necessary to use a conventional bail 200, as shown in FIG. 11, rather than the illustrated connection of the rope 32 to the dipper 28, to obtain the desired tipping up of the dipper 28 after the bank is cleared.

As is apparent from the foregoing, the pivotal position of the dipper 28 relative to the dipper handle 18 automatically varies depending on the pivotal position of the handle 18, on external forces on the dipper 28, on the angle 40 of the hoist rope 32 relative to the dipper 28, and on the translational position of the handle 18. The varying pivotal position of the dipper 28 increases the fill factor, reduces wear, vibration and shock on the dipper 28 and on the remainder of the power shovel 10 by acting as a shock attenuator, reduces the cycle time, and helps prevent stalling by providing an improved dipper attitude relative to the bank.

If necessary to insure that the braces 70 move in unison, the two variable pitch braces 70 can be tied together by torsionally stiff members (not shown).

Various features of the invention are set forth in the following claims.

We claim:

1. A power shovel comprising a frame, a dipper handle mounted on said frame for pivotal movement relative thereto about a generally horizontal dipper handle axis, a dipper connected to said handle for pivotal movement relative thereto about a generally horizontal dipper axis, and a collapsible shock attenuator means connected between said handle and said dipper at a point spaced from said dipper axis, said shock attenuator allowing limited pivotal movement of said dipper relative to said handle and about said dipper axis.

2. A power shovel comprising a frame, a dipper handle mounted on said frame for pivotal movement relative thereto about a generally horizontal dipper handle axis, a dipper connected to said handle for pivotal movement relative thereto about a generally horizontal dipper axis, and a shock attenuator connected between said handle and said dipper at a point spaced from said dipper axis, said shock attenuator allowing limited pivotal movement of said dipper relative to said handle and about said dipper axis wherein said shock attenuator includes a first link connected to said handle for pivotal movement relative thereto about an upper handle axis, and a second link which is connected to said dipper for pivotal movement relative thereto about an upper dipper axis, and which is connected to said first link for pivotal movement relative thereto about a link axis spaced from said upper handle axis and from said upper dipper axis, and a spring which extends between said links and which varies the angle between said first and second links, thereby varying the distance between said upper handle axis and said upper dipper axis.

3. A power shovel as set forth in claim 2 wherein said links have respective inner ends connected for relative pivotal movement about said link axis and have respective outer ends, wherein said first link is pivotally connected to said handle at a point intermediate said inner and outer ends of said first link, wherein said second link is pivotally connected to said dipper at a point intermediate said inner and outer ends of said second link, and wherein said spring extends between said outer ends of said links.

4. A power shovel as set forth in claim 2 wherein said spring includes a gas spring having one pivotally connected to said first link and having an opposite end pivotally connected to said second link.

5. A power shovel as set forth in claim 4 wherein said links include a mechanical stop limiting relative pivotal movement of said links so as to limit contraction of said spring.

6. A power shovel as set forth in claim 5 wherein said links include a mechanical stop limiting relative pivotal movement of said links so as to limit extension of said spring.

7. A power shovel as set forth in claim 1 and further comprising a winch mounted on said frame, a boom having a lower end mounted on said frame and having an upper end, and a sheave rotatably mounted on said boom adjacent said upper end thereof, wherein said dipper handle is mounted on said boom for pivotal movement relative thereto and for translational movement relative thereto, and wherein said shovel further comprises a hoist rope extending over said sheave, having one end connected to said winch and having an opposite end connected to said dipper such that actuation of said winch causes pivotal movement of said handle relative to said boom.

8. A power shovel comprising a frame, a dipper handle mounted on said frame for pivotal movement relative thereto about a generally horizontal dipper handle axis such that said dipper handle has a variable pivotal position relative to said frame, a dipper connected to said handle for pivotal movement relative thereto about a generally horizontal dipper axis such that said dipper has a variable pivotal position relative to said handle, said dipper having external forces exerted thereon during normal operation of said power shovel, and a variable pitch brace connected between said handle and said dipper at a point spaced from said dipper axis, said variable pitch brace including a spring biasing said dipper in one rotational direction relative to said handle and about said dipper axis, such that said pivotal position of said dipper automatically varies depending on said pivotal position of said handle and on external forces on said dipper.

9. A power shovel as set forth in claim 8 and further comprising a hoist rope connected to one of said dipper and said handle for pivoting said handle relative to said frame.

10. A power shovel as set forth in claim 9 and further comprising a winch mounted on said frame, a boom having a lower end mounted on said frame and having an upper end, and a sheave rotatably mounted on said boom adjacent said upper end thereof, wherein said dipper handle is mounted on said boom for pivotal movement relative thereto and for translational movement relative thereto such that said handle has a translational position relative to said frame, wherein said hoist rope extends over said sheave, has one end connected to said winch and has an opposite end connected to said dipper so as to define an angle between said hoist rope and said dipper and so that actuation of said winch causes pivotal movement of said handle relative to said boom, and wherein said pivotal position of said dipper further automatically varies depending on the angle of said hoist rope relative to said dipper and on said translational position of said handle.

11. A power shovel as set forth in claim 8 wherein said dipper handle is also mounted on said frame for translational movement relative thereto such that said handle has a translational position relative to said frame, and wherein said pivotal position of said dipper further automatically varies depending on said translational position of said handle.

12. A power shovel as set forth in claim 8 wherein said handle is moveable relative to a generally horizontal position in which said dipper has an upper end and in which said spring biases said upper end of said dipper away from said handle.

13. A power shovel as set forth in claim 8 wherein said dipper has a tooth cutting angle, and wherein said spring biases said dipper in the direction decreasing said tooth cutting angle.

14. A power shovel as set forth in claim 8 wherein said variable pitch brace is connected to said handle for pivotal movement relative thereto about an upper handle axis, is connected to said dipper for pivotal movement relative thereto about an upper dipper axis, and varies the distance between said upper handle axis and said upper dipper axis.

15. A power shovel as set forth in claim 14 wherein said spring biases said upper dipper axis away from said upper handle axis.

16. A power shovel as set forth in claim 15 wherein said variable pitch brace includes a first link connected to said handle for pivotal movement relative thereto about said upper handle axis, and a second link which is connected to said dipper for pivotal movement relative thereto about said upper dipper axis, and which is connected to said first link for pivotal movement relative thereto about a link axis spaced from said upper handle axis and from said upper dipper axis, and wherein said spring varies the angle between said first and second links, thereby varying the distance between said upper handle axis and said upper dipper axis.

17. A power shovel as set forth in claim 16 wherein said links have respective inner ends connected for relative pivotal movement about said link axis and have respective outer ends, wherein said first link is pivotally connected to said handle at a point intermediate said inner and outer ends of said first link, wherein said second link is pivotally connected to said dipper at a point intermediate said inner and outer ends of said second link, and wherein said spring extends between said outer ends of said links.

18. A power shovel as set forth in claim 16 wherein said spring includes a gas spring having one end pivotally connected to said first link and having an opposite end pivotally connected to said second link.

19. A power shovel as set forth in claim 18 wherein said links include a mechanical stop limiting relative pivotal movement of said links so as to limit contraction of said spring.

20. A power shovel as set forth in claim 18 wherein said links include a mechanical stop limiting relative pivotal movement of said links so as to limit extension of said spring.

21. A power shovel comprising a frame, a winch mounted on said frame, a boom having a lower end mounted on said frame and having an upper end, a sheave rotatably mounted on said boom adjacent said upper end thereof, a dipper handle mounted on said boom for pivotal movement relative thereto and for translational movement relative thereto, a dipper connected to said handle for pivotal movement relative thereto about a generally horizontal lower dipper axis, and a variable pitch brace connected between said handle and said dipper, said variable pitch brace including a first link connected to said handle for pivotal movement relative thereto about a generally horizontal upper handle axis spaced from said lower dipper axis, and a second link which is connected to said dipper for pivotal movement relative thereto about a generally horizontal upper dipper axis spaced from said lower dipper axis, and which is connected to said first link for pivotal movement relative thereto about a link axis spaced from said upper handle axis and from said upper dipper axis, and a gas spring extending between said links such that said spring biases said links so as to increase the angle between said links, thereby increasing the distance between said upper handle axis and said upper dipper axis.

22. A power shovel as set forth in claim 21 and further comprising a hoist rope extending over said sheave, having one end connected to said winch and having an opposite end connected to said dipper such that actuation of said winch causes pivotal movement of said handle relative to said boom.

23. A power shovel as set forth in claim 21 wherein said links have respective inner ends connected for relative pivotal movement about said link axis and have respective outer ends, wherein said first link is pivotally connected to said handle at a point intermediate said inner and outer ends of said first link, wherein said second link is pivotally connected to said dipper at a point intermediate said inner and outer ends of said second link, and wherein said spring extends between said outer ends of said links.

24. A power shovel as set forth in claim 23 wherein said links include a mechanical stop limiting relative pivotal movement of said links so as to limit contraction of said spring.

25. A power shovel as set forth in claim 24 wherein said links include a mechanical stop limiting relative pivotal movement of said links so as to limit extension of said spring.

26. A method of operating a power shovel including a frame, a dipper handle mounted on said frame for pivotal movement relative thereto about a generally horizontal dipper handle axis such that said dipper handle has a variable pivotal position relative to said frame, said dipper handle having a centerline, and said dipper handle being mounted on said frame for translational movement relative thereto such that said handle has a translational position relative to said frame, a dipper connected to said handle for pivotal movement relative thereto about a generally horizontal dipper axis such that said dipper has a variable pivotal position relative to said handle and such that said dipper can be crowded by moving said dipper handle translationally, said dipper having thereon digging teeth defining a tooth cutting angle relative to said dipper handle centerline, said dipper being pivotable upwardly from a tucked position, and said dipper having external forces exerted thereon during normal operation of said power shovel, and a variable pitch brace connected between said handle and said dipper at a point spaced from said dipper axis, said variable pitch brace including an extendable and contractible spring biasing said dipper in a rotational direction, relative to said handle and about said dipper axis, decreasing said tooth cutting angle, such that said pivotal position of said dipper automatically varies depending on said pivotal position of said handle, on said translational position of said handle, and on external forces on said dipper, said method comprising the steps of (a) locating said dipper in said tucked position with said spring extended to minimize said tooth cutting angle, (b) pivoting said dipper upwardly from said tucked position to contact material to be excavated, (c) pivoting said dipper further upwardly and crowding said dipper to cause said spring to contract to increase said tooth cutting angle, and (d) pivoting said dipper further upwardly to cause said spring to extend to decrease said tooth cutting angle.

27. A method as set forth in claim 26 and further comprising, after step (d), step (e) of pivoting said dipper further upwardly to cause said spring to contract to increase said tooth cutting angle.

28. A method as set forth in claim 27 wherein step (e) also includes crowding said dipper.

* * * * *